US006602112B2

(12) United States Patent
Tran et al.

(10) Patent No.: US 6,602,112 B2
(45) Date of Patent: Aug. 5, 2003

(54) DISSOLUTION OF METAL PARTICLES PRODUCED BY POLISHING

(75) Inventors: Tony Quan Tran, Newark, DE (US); Vikas Sachan, Hockessin, DE (US); David Gettman, Fresno, CA (US); Terence M. Thomas, Newark, DE (US); Craig D. Lack, Wilmington, DE (US); Peter A. Burke, Avondale, PA (US)

(73) Assignee: Rodel Holdings, Inc., Wilmington, DE (US)

( * ) Notice: Subject to any disclaimer, the term of this patent is extended or adjusted under 35 U.S.C. 154(b) by 201 days.

(21) Appl. No.: 09/764,817

(22) Filed: Jan. 18, 2001

(65) Prior Publication Data

US 2001/0039166 A1 Nov. 8, 2001

Related U.S. Application Data

(60) Provisional application No. 60/176,576, filed on Jan. 18, 2000.

(51) Int. Cl.[7] ..... B24B 1/00

(52) U.S. Cl. ..... 451/36; 451/41; 451/54; 451/56; 451/59; 451/60

(58) Field of Search ..... 216/88, 89; 438/692, 438/693; 451/6, 8, 36, 41, 54, 56, 59, 60, 63

(56) References Cited

U.S. PATENT DOCUMENTS

| | | | | |
|---|---|---|---|---|
| 4,992,135 A | | 2/1991 | Doan | |
| 5,439,551 A | | 8/1995 | Meikle et al. | |
| 5,755,614 A | * | 5/1998 | Adams et al. | 134/902 |
| 5,775,980 A | * | 7/1998 | Sasaki et al. | 451/285 |
| 5,782,675 A | | 7/1998 | Southwick | |
| 6,014,218 A | * | 1/2000 | Bradl et al. | 356/600 |
| 6,066,028 A | * | 5/2000 | Cheng et al. | 451/28 |
| 6,071,177 A | * | 6/2000 | Lin et al. | 156/345.13 |
| 6,183,351 B1 | * | 2/2001 | Aoki | 210/739 |
| 6,217,416 B1 | * | 4/2001 | Kaufman et al. | 451/41 |
| 6,242,351 B1 | * | 6/2001 | Li et al. | 216/89 |
| 6,270,395 B1 | * | 8/2001 | Towery et al. | 451/28 |
| 6,358,125 B2 | * | 3/2002 | Kawashima et al. | 210/416.1 |
| 6,375,545 B1 | * | 4/2002 | Yano et al. | 451/36 |
| 6,447,371 B2 | * | 9/2002 | Brusic Kaufman et al. | 106/3 |

FOREIGN PATENT DOCUMENTS

| | | |
|---|---|---|
| EP | 0268 361 A | 5/1988 |
| GB | 987 556 A | 3/1965 |
| WO | WO96/25270 A1 | 8/1996 |

* cited by examiner

*Primary Examiner*—Timothy V. Eley
(74) *Attorney, Agent, or Firm*—Anuradha Ramana; Blake T. Biederman

(57) ABSTRACT

A method for polishing a surface of metal on a semiconductor substrate by using a polishing pad and hydrogen peroxide, and removing particles of metal from the semiconductor substrate by polishing, and dissolving the particles in the quantity of hydrogen peroxide.

15 Claims, No Drawings

DISSOLUTION OF METAL PARTICLES PRODUCED BY POLISHING

This application claims the benefit of U.S. Provisional Patent Application Ser. No. 60/176,576 filed Jan. 18, 2000.

The present invention relates to dissolution of metal particles that are produced by polishing a semiconductor substrate.

Polishing compositions consist of an aqueous solution, which contains an oxidizing agent, and often times a complexing agent. A polishing composition known as a slurry contains abrasive particles. The part, or semiconductor substrate, is bathed or rinsed in the polishing composition while a polishing pad is pressed against the substrate and the pad and substrate are moved relative to each other. Thus, the lateral motion of the pad relative to the pad results in wear and volumetric removal of the substrate surface.

The metal particles (e.g., copper) fracture and are removed or released from the surface of the substrate by and during polishing of the surface with a polishing pad. Metal particles are most likely to be produced by polishing when the surface is particularly rough. The removed metal particles and other asperities cause a darkening (e.g., graying or blackening) by reaction with the polishing composition, and further darken the polishing pad, thereby interfering with optical wafer loss detectors or optical end point detectors. The metal particles obstruct an optical path through a transparent portion of a polishing pad. The optical path is used by optical detectors that monitor the semiconductor substrate for wafer loss or that monitor for, and detect, complete removal of a layer of metal from a semiconductor substrate, as an indication of a desired end point of the polishing operation, at which end point the polishing operation is substantially slowed or ceased, to prevent overpolishing, meaning excessive removal of material from the semiconductor substrate being polished. Further, the metal particles block or obstruct slurry particles from the surface, which impedes polishing of the surface. Further, the metal particles can scratch the surface being polished by a polishing pad.

It is thus desirable to avoid the presence of metal particles that have been removed from a semiconductor wafer.

It has been found that hydrogen peroxide dissolves metal particles that have been removed from a semiconductor substrate during polishing of the substrate with a polishing pad. The metal particles are dissolved to minimize obstruction of slurry from the surface being polished, and to avoid scratching and other damage to the surface being polished. Further, the metal particles are dissolved to minimize interference with optical wafer loss and end point detectors. Embodiments of the invention will now be described by way of example.

In an embodiment, the hydrogen peroxide solution is used to pre-treat the polishing pad. In this embodiment, the hydrogen peroxide solution is dispensed onto the polishing pad to prepare the pad for polishing. However, just prior to polishing of the substrate, the hydrogen peroxide solution is discontinued, leaving a quantity of hydrogen peroxide on the pad. During the start of polishing of a metal surface on a semiconductor substrate, using the pad and a polishing composition, the metal surface is initially rough, and particles of metal are removed by the polishing operation. Hydrogen peroxide left on the pad dissolves particles of metal that have been removed by polishing. Polishing of the surface is continued, until the surface being polished is smoothed and the production of particles of metal is significantly reduced. Polishing continues after the quantity of hydrogen peroxide dissipates. The quantity of hydrogen peroxide is present for a limited time duration, which is sufficient to dissolve the particles of metal that have been removed from the semiconductor substrate.

According to a further embodiment of the invention, a method for polishing a semiconductor substrate to remove metal, comprises, polishing the semiconductor substrate with a polishing pad and a polishing composition, removing particles of the metal from the semiconductor substrate by said polishing, dispensing hydrogen peroxide onto the polishing pad for a limited time duration to dissolve the particles, and dissolving the particles in the hydrogen peroxide.

According to a further embodiment of the invention, a method includes, monitoring the thickness of the metal on the semiconductor substrate by way of an optical path through at least a portion of the polishing pad that is transparent, and dissolving the particles in the hydrogen peroxide to eliminate obstruction of the optical path by the particles.

In yet another embodiment, the hydrogen peroxide solution is dispensed onto the polishing pad towards the end of the polishing cycle. Metal particles that have darkened by oxidation or by chemical reaction with the polishing composition, are dissolved by the hydrogen peroxide.

The hydrogen peroxide can be controlled by dispensing a hydrogen peroxide solution in conjunction with a CMP polishing composition. Preferably, the method is used as the first step of a two-step copper polishing process. The presence of the hydrogen peroxide dissolves the dark particles that can form during first step copper polishing A method is provided for chemical-mechanical polishing of semiconductor substrates, comprising dispensing hydrogen peroxide in conjunction with a polishing slurry comprising: water, an optional complexing agent, submicron abrasive particles, and an oxidizing agent.

A method is provided for chemical-mechanical polishing of semiconductor substrates, in conjunction with a polishing composition comprising: water, a complexing agent, and an oxidizing agent. The composition may be a slurry having submicron abrasive particles.

Hydrogen peroxide can be present in a hydrogen peroxide solution at a concentration of about 0.01, 0.1, 1, 2, 3, 4, 5, 10, 15, 20, 25, to 30% by weight. Preferably, hydrogen peroxide is present in the hydrogen peroxide solution at a concentration of about 0.5, 1, 2, or 2.5% by weight, even more preferably about 1% by weight. The hydrogen peroxide solution can be (1) premixed with the polishing composition being used and the resultant mixture dispensed onto the polishing pad, (2) dispensed onto the polishing pad separately from the polishing composition, or (3) dispensed concurrently with the polishing composition (i.e., mixing would occur at the point of dispensing or within the dispensing apparatus). Preferably, the hydrogen peroxide solution is dispensed onto the polishing pad separately from the polishing composition. Such separate dispensing allows for greater control of the presence of hydrogen peroxide. One method of premixing is mixing both solutions together in a chamber and then pumping the resulting solution onto the polishing pad. Premixing can also be accomplished by pumping both solutions simultaneously through the same dispensing channel (e.g., tube).

The flow rate of hydrogen peroxide solution and polishing composition can be varied to maintain the desired ratio of hydrogen peroxide to polishing composition on the polishing surface. It is preferred that the flow rates are equal (e.g., 200 mL/min of hydrogen peroxide solution and 200 mL/min of polishing composition). When using equal flow rates, it is preferred that the hydrogen peroxide solution is 1% by weight hydrogen peroxide. The flow rate of the hydrogen peroxide solution can be varied as the weight % of hydrogen peroxide varies. For example, if a 30% hydrogen peroxide solution, a commercially available concentration, is used, then the flow rate is preferably one thirtieth of the above-noted 200 mL/min (i.e., approximately 7 mL/min). Conversely, if a 0.5% hydrogen peroxide solution is used, then 400 mL/min of hydrogen peroxide solution would preferably be used with 200 mL/min of polishing composition. The above noted flow rates can be used for the premixing, separate, or concurrent dispensing techniques.

Since hydrogen peroxide is an oxidizing agent, its presence can cause damage to the wafer surface if it is dispensed with the polishing slurry for too long of a period. Thus, the wafer is preferably polished for 1, 2, 3, 4, 5, 6, 7, 8, 9, or 10 seconds in the presence of the hydrogen peroxide solution, more preferably 1, 2, 3, 4, or 5 seconds, and even more preferably about 3 seconds. Preferably, the polishing pad is wet with the hydrogen peroxide solution and polishing slurry at the time when the carrier and wafer touch-down to the pad just prior to polishing the wafer.

Preferred complexing agents in accordance with the present invention include compounds having at least two acid moieties present in the structure, which can affect complexation to the target metal, such as copper. Acid moieties are defined as those functional groups having a dissociable proton. These include, but are not limited to, carboxyl, carboxylate, hydroxyl, sulfonic and phosphonic groups. Carboxylate and hydroxyl groups are preferred, as these are present in the widest variety of effective species. Particularly effective are structures which possess two or more carboxylate groups with hydroxyl groups in an alpha position, such as straight chain mono- and di-carboxylic acids and salts including, for example, malic acid and malates, tartaric acid and tartarates and gluconic acid and gluconates. Also effective are tri- and polycarboxylic acids and salts with secondary or tertiary hydroxyl groups in an alpha position relative to a carboxylic group such as citric acid and citrates. Also effective are compounds containing a benzene ring such as ortho, di- and polyhydroxybenzoic acids and acid salts, phthalic acid and acid salts, pyrocatecol, pyrogallol, gallic acid and gallates and tannic acid and tannates. The most preferred complexing agents of the present invention will tend to complex with metal anions, forming a 5 or 6 member ring, whereby the metal atom forms a portion of the ring.

Preferred particles of abrasive of a slurry, polishing composition, are readily dispersible in an aqueous medium. The particles preferably have a surface area ranging from about 40, 60, 80, 100, 150, 200 $m^2/g$ to about 250, 300, 350, 400, 450 $m^2/g$, and an aggregate size distribution less than about 1.0 micron, a mean aggregate diameter less than about 0.4 micron. The particles of the present invention are inorganic oxides selected from silica, alumina, ceria, zirconia and/or derivatives thereof and optionally can further include second inorganic oxide. The slurries of the present invention can be stable, but are more preferably meta-stable.

Useful oxidizing agents in accordance with the polishing composition include any water-soluble composition capable of receiving an electron from the metal atoms at the surface of the substrate during the polishing operation. By receiving electrons from the metal surface of the substrate, the oxidizing agent can transform metal atoms at the substrate surface into water-soluble anions. In this way, the oxidizing agent promotes a type of dissolving of the metal into the slurry's aqueous medium. Useful oxidizing agents include acids, salts, peroxides and the like, for example: nitrates, sulfates (including persulfates), iodates (including periodates), hydrogen peroxide and/or acid derivatives thereof. Ordinary skill and experimentation may be necessary in selecting an oxidizing agent, depending upon the polishing system and substrate chosen. Preferred oxidizing agents would generally include iodates. Oxidizing agents in compositions of the present invention may be comprised of nitrates, iodates, perchlorates, sulfates, peroxides, or any other commonly known oxidizing agent. Counter ions such as sodium, lithium, calcium, potassium, ammonium, and magnesium can be used. Generally oxidizing agents are used in slurries for CMP at about 1, 2, 3, 4, 5, 6, 7, 8, 9, to 10% by weight. Preferably, the oxidizing agent is present at about 2, 3, 4, 5, 6, to 7% by weight. Preferably, the oxidizing agent is other than hydrogen peroxide and a ferric oxidizer (e.g., ferric nitrate, ferric sulfate, ferric chloride, and ammonium ferrate). When the oxidizing agent is potassium iodate, it is preferably present at about 2, 3, or 4% by weight. Even more preferably potassium iodate is present at about 3% by weight. When the oxidizing agent is iodic acid, it is preferably present in the slurry in an amount greater than 0% by weight and less than about 1.8% by weight. More preferably, the iodic acid is present at about 0.1, 0.2, 0.3, 0.4, 0.5, 0.6, 0.7, 0.8, 0.9, 1.0, 1.1, 1.2, 1.3, 1.4, 1.5, 1.6, or 1.7% by weight. Even more preferably, the iodic acid is present at about 1.5% by weight.

The preferred complexing agents of the present invention are a class of compounds, having at least two acid moieties present in the structure, which can effect complexation to the target metal anion. Acid species are defined as those functional groups having a dissociable proton. These include, but are not limited to, carboxyl, carboxylate, hydroxyl, sulfonic and phosphonic groups. Carboxylate and hydroxyl groups are preferred as these are present in the widest variety of effective species. Preferably, the pKa of the first acid species is not substantially larger than the pH of the polishing solution. "Substantially" is intended to mean about 1 unit (pKa or pH).

Particularly effective complexing agents of the present invention have a structure that possesses one or more carboxylate groups with hydroxyl groups in an alpha position, such as straight chain mono- and di-carboxylic acids and salts including, for example, malic acid and malates, tartaric acid and tartarates and gluconic acid and gluconates. Also effective complexing agents are tri- and polycarboxylic acids and salts with secondary or tertiary hydroxyl groups in an alpha position relative to a carboxylic group such as citric acid and citrates. Also effective complexing agents are compounds containing a benzene ring such as ortho di- and polyhydroxybenzoic acids and acid salts, phthalic acid and acid salts, pyrocatecol, pyrogallol, gallic acid and gallates and tannic acid and tannates. The reason for the effectiveness of these compounds is believed to lie in the extensive electron delocalization observed in the structures. This delocalization leads to a high degree of stability for the conjugate base in solution, as evidenced by the low pKa values:

Tartaric acid: $pKa_1$–3.02

Citric acid: $pKa_1$–3.1

Phthalic acid: $pKa_1$=2.95

The pKa limitations set forth in the present invention are due to the requirement that the free anion or conjugate base must be present in reasonable concentration for the complexing effect to occur. At pH<<pKa little free anion is present. At pH=pKa, the acid is 50% dissociated. At pH>>pKa, essentially all of the acid is present as the anion. Thus the dissociation constant must be chosen to reflect the range of pH values normally encountered in polishing. Ideally, the pH of the polishing composition should be equal to or greater than a value equal to the $pKa_1$ of the additive used for silica rate suppression. If the $pKa_1$ of the additive is substantially greater than the composition pH, insufficient free metal anion is produced in solution and the advantageous complexing effect is inhibited. Thus additives such as tartaric, citric and phthalic acid ($pKa_1 \leqq 3.1$) should be effective over a pH range corresponding to the normal pH range encountered in polishing metals (pH.about 0.4–11) and would be preferred. In contrast, addition of pyrocatechol ($pKa_1 \approx 10$) would only be useful at very high solution pH and would have a more restricted utility.

Generally speaking, the complexing agents in accordance with the present invention are preferably used in concentrations of from about 0.5, 1, 2, 3, 4, 5, 6, 7, 8, 9, to 10 weight percent, more preferably about 0.5, 1, 2, 3, 4, to 5 wt. %. Preferably, the complexing agent is malic acid, tartaric acid, gluconic acid, glycolic acid, citric acid, phthalic acid, pyrocatecol, pyrogallol, gallic acid, or tannic acid. More preferably, the complexing agent is citric acid. Another more preferred complexing agent is glycolic acid. Preferably, citric acid is present in a concentration of about 0.5, 1, 1.5, 2 wt. % and more preferably about 1.0 wt. %. Complexing agents may be used in the compositions of this invention individually or in combinations of two or more. Preferred complexing agents of the present invention will tend to complex with metal anions, forming a 5 or 6 member ring, whereby the metal atom forms a portion of the ring.

The submicron abrasive particles in the compositions of the present invention may be comprised of any of the oxides used for chemical-mechanical polishing such as, alumina, silica, ceria, titania, and zirconia. Preferably, the submicron abrasive particles are alumina. Generally the total amount of abrasive particles used in slurries of the present invention is about 1, 2, 3, 4, 5, 6, 7, 8, 9, 10, 11, 12, 13, 14, or 15% by weight. When the submicron abrasive particles are alumina, then they are preferably present at about 1, 2, 3, 4, 5, or 6% by weight, even more preferably about 3% by weight. Preferably, the submicron abrasive particles of the present invention are absent of an organic solubility coating (e.g., a phthalate compound coated thereon).

Substrates polishable using slurries of the present invention are comprised of silica (e.g., TEOS) and a layer of at least one metal selected from aluminum, copper, and tungsten. Often times a barrier layer or film is used between the aluminum, copper or tungsten and the silica. The barrier layer is preferably at least one layer comprised of titanium, titanium nitride, tantalum, or tantalum nitride. Alternatively, two different barrier layers can be used, preferably titanium/titanium nitride or tantalum/tantalum nitride. A preferred substrate is one wherein a copper layer is separated from the silica substrate via a tantalum nitride layer. Another preferred substrate is one wherein a copper layer is separated from the silica substrate via tantalum layer.

The slurries are particularly well suited for polishing operations having high polishing surface speeds. For example, many newer polishing machines are polishing at increasingly higher revolutions per minute, and the slurries of the present invention are particularly well suited for such high speed polishing (e.g., rotary polishing speeds greater than 100 rpm, greater than 150 rpm and/or greater than 200 rpm).

The slurries of the present invention are also well suited for polishing dielectrics (silica), including low k dielectrics, such as porous silica, or organic low k dielectrics, such as fluoro polymers or copolymers.

Polishing Procedures

Wafers were polished on an Applied Materials Mirra polishing machine (available from Applied Materials) using a IC1000 K groove polishing pad on platen 1 and 2, a Politex Regular Embossed polishing pad on platen 3, ABT 68 $\mu$m Diamond conditioner, and 200 mm wafer size. The IC1000 K groove pad was mounted to platens 1 and 2 and 20 pre-condition sweeps with DI water. Politex regular embossed pad was mounted to platen 3 and preconditioned with the 6" stiff bristle hand brush and DI water hand sprayer, 8 scrapes, and 8 brushes. The conditioning parameters were 7 psi DF, 3 platen sweeps (post with DI Water), 70-rpm platen speed, and 75-rpm disk speed.

The primary polishing pad was wet with the slurry/peroxide mix for 10 seconds (in order to obtain a uniformly wet pad). For 10 seconds, the retaining ring on the polishing head is placed in contact with the pad while the wafer is held just above the pad, but not in contact. The speed of the polishing pad is then increased and pressure applied to the wafer for 3 seconds. The pressure on the wafer is less then in the main polish step. This phase is designed to smooth the wafer. Addition of the peroxide solution is discontinued and the main polishing step is then performed 3 seconds later.

The following polishing parameters are used (depending on the tested substrate):

| Parameter | Phase 1 (Slurry Prime) | Phase 2 (Touchdown) | Phase 3 (Ramp Up) | Main Polish Step |
|---|---|---|---|---|
| Time (seconds) | 10 | 10 | 7 | 45 |
| Membrane Pressure (psi) | Vacuum | Vacuum | 2 | 6 |
| Platen Speed (rpm) | 63 | 63 | 131 | 131 |
| Carrier Speed (rpm) | 0 | 41 | 129 | 129 |
| Inner Tube Pressure (psi) | 2 | 2 | 2 | 6 |
| Retaining Ring Pressure (psi) | Vacuum | 4 | 4 | 6.9 |
| Slurry Flow (ml/min) | 200 | 200 | 200 | 200 |
| Peroxide Flow (ml/min) | 200 | 200 | 200 (First 3 seconds) | 0 |

For primary polish Cu is 45 seconds.

For the test, 2 dummy Cu wafers were run followed by:

Cu=45 seconds

ToX=120 sec

Defect=30 sec.

Removal Rate analysis was performed using a 25-point polar measurement site map on the CDE Resmap. Edge exclusion of 10 mm for Cu.

EXAMPLE 1

The following slurries were tested on 6" wafers containing Cu, TaN, and $SiO_2$.

| Slurry[1] | $KIO_3$ | CA | Alumina | pH |
|---|---|---|---|---|
| Control-a | 2.0 | 1.0 | 3.0 | 3.6 |

[1]All numbers are given in weight percentages. Water comprises the remaining weight of the slurries.
CA = citric acid.

Observed Metal/Oxide removal rates (Å/min)

| Slurry* | Cu | TaN | Thermal Oxide |
|---|---|---|---|
| Control-a | 3290 | 88 | 163 |
| Iodic Acid | 2434 | 90 | 110 |
| Control-b | 3939 | 91 | 168 |

Embodiments of the invention have been described by way of example. Other embodiments and modifications of the invention are intended to be covered by the sprit and scope of the appended claims.

What is claimed is:

1. A method for polishing metal on a semiconductor substrate, comprising the steps of:

dispensing hydrogen peroxide onto a polishing pad to prepare the polishing pad for polishing, leaving a quantity of the hydrogen peroxide on the polishing pad, polishing a surface of the metal on a semiconductor substrate by using the polishing pad and the quantity of the hydrogen peroxide and a polishing composition, removing particles of the metal from the seimiconductor substrate by said polishing, dissolving the particles of the metal in the quantity of the hydrogen peroxide, continuing to polish the surface of the metal using the polishing pad and the polishing composition until the surface is smoothed to produce reduced quantities of particles by polishing, and continuing to polish the surface of the metal using the polishing pad and the polishing composition after the hydrogen peroxide has dissipated.

2. The method as recited in claim 1 wherein the step of dispensing the hydrogen peroxide dispenses the hydrogen peroxide in a solution including water; and the hydrogen peroxide is present in about 0.5 to 5% by weight.

3. The method as recited in claim 1 wherein the step of dispensing the hydrogen peroxide dispenses the hydrogen peroxide in a solution including water; and the hydrogen peroxide is about 1% by weight.

4. The method as recited in claim 1 wherein the step of dispensing hydrogen peroxide dispenses the hydrogen peroxide for a limited time duration of about 1 to 10 seconds.

5. The method as recited in claim 1 wherein the step of dispensing hydrogen peroxide dispenses the hydrogen peroxide for a limited time duration of about 3 seconds.

6. The method as recited in claim 1, and further including the steps of:

dispensing a second quantity of hydrogen peroxide onto the polishing pad for a limited time duration to dissolve additional particles of the metal that have been removed from the semiconductor substrate by polishing the semiconductor substrate with the polishing pad and the polishing composition, and dissolving the additional particles in the second quantity of hydrogen peroxide.

7. The method as recited in claim 6, further including the step of:

mixing the second quantity of hydrogen peroxide with the polishing composition prior to the step of dispensing the second quantity of hydrogen peroxide onto the polishing pad.

8. The method as recited in claim 6, wherein the step of dispensing the second quantity of hydrogen peroxide occurs separately from the polishing composition.

9. The method as recited in claim 6, further including the step of:

monitoring the thickness of the metal on the semiconductor substrate by optical monitoring through an optical path through at least a portion of the polishing pad that is transparent, and wherein the step of disssolving the additional particles dissolves the additional particles in the second quantity of hydrogen peroxide to eliminate obstruction of the optical path by the additional particles.

10. The method as recited in claim 6, wherein the step of dispensing the second quantity of hydrogen peroxide dispenses the second quantity of hydrogen peroxide on the polishing pad after a substantial amount of the metal has been removed by polishing the semiconductor substrate with the polishing pad and the polishing composition, and wherein the step of dissolving the additional particles dissolves the additional particles in the second quantity of hydrogen peroxide to eliminate obstruction of an optical path through at least a portion of the polishing pad that is transparent, and further including the step of:

monitoring for an end point of metal removal by optical monitoring through the optical path.

11. The method as recited in claim 6 wherein the step of dispensing the second quantity of hydrogen peroxide dispenses the second quantity of hydrogen peroxide in a solution.

12. The method as recited in claim 6 wherein the step of dispensing the second quantity of hydrogen peroxide dispenses the second quantity of hydrogen peroxide in a solution comprising, water and the hydrogen peroxide present in about 0.5 to 5% by weight.

13. The method as recited in claim 6 wherein the step of dispensing the second quantity of hydrogen peroxide dispenses the second quantity of hydrogen peroxide in a solution including water; and the hydrogen peroxide is about 1% by weight.

14. The method as recited in claim 6 wherein the step of dispensing the second quantity of hydrogen peroxide dispenses the second quantity of hydrogen peroxide for the limited time duration of about 1 to 10 seconds while continuing to polish the semiconductor substrate with the polishing pad and the polishing composition.

15. The method as recited in claim 6 wherein the step of dispensing the second quantity of hydrogen peroxide dispenses the second quantity of the hydrogen peroxide for the limited time duration of about 3 seconds while continuing to polish the semiconductor substrate with the polishing pad and the polishing composition.

* * * * *